US006393994B1

(12) United States Patent
Azimi

(10) Patent No.: US 6,393,994 B1
(45) Date of Patent: May 28, 2002

(54) SPECIAL ELECTRICAL CAB FOR RAIL ROADS

(76) Inventor: Sadegh Azimi, 12304 Caminito Mirada, San Diego, CA (US) 92131

( * ) Notice: Subject to any disclaimer, the term of this patent is extended or adjusted under 35 U.S.C. 154(b) by 0 days.

(21) Appl. No.: 09/696,437

(22) Filed: Oct. 24, 2000

Related U.S. Application Data

(60) Provisional application No. 60/174,450, filed on Jan. 5, 1999.

(51) Int. Cl.[7] ..... B61B 13/00
(52) U.S. Cl. ..... 104/138.1
(58) Field of Search ..... 104/138.1, 138.2; 404/1; 406/51, 84, 110, 186

(56) References Cited

U.S. PATENT DOCUMENTS 266,715 A * 12/1882 Needham ..... 104/138.1
624,202 A * 5/1899 Fordyce ..... 104/138.1
1,336,732 A * 4/1920 Davy ..... 104/138.1
3,090,328 A * 5/1963 Berggren ..... 104/138.1
3,438,337 A * 4/1969 Edwards ..... 104/138.1
3,565,011 A * 2/1971 Edwards ..... 104/138.1
3,566,800 A * 3/1971 Chuan ..... 104/138.1
3,605,629 A * 9/1971 Edwards ..... 104/138.1
3,888,434 A * 6/1975 Chersky et al. ..... 104/138.1
4,184,792 A * 1/1980 Turnbo ..... 406/51

* cited by examiner

*Primary Examiner*—Mark T. Le
(74) *Attorney, Agent, or Firm*—Lyon & Lyon LLP

(57) ABSTRACT

A method and apparatus for reducing the resistance to the motion of vehicles due to air displacement and air friction by reducing the air pressure in an enclosed passageway for vehicular travel. Balance rooms are provided for entering the enclosed passageway without significantly increasing the air pressure in the passageway. Alternatively, the air in the passageway is replaced with a gas with a lesser molecular weight than air, to reduce the resistance to motion.

16 Claims, 4 Drawing Sheets

SPECIAL ELECTRICAL CAB FOR RAIL ROADS

This application claims benefit of Provisional application Ser. No. 60/174,450 filed Jan. 5, 1999.

BACKGROUND OF THE INVENTION

1. Field of the Invention

The field of the present invention relates to mass transit travel systems, more specifically, to reducing the resistance to motion of vehicles by reducing the air pressure in the passageways.

2. Background

An average-size car traveling at 55 miles (85 kilometers) per hour uses more than 60 percent of its fuel and power to overcome wind resistance. Aerodynamically efficient design greatly reduces the car's drag, improving gas mileage.

Drag is primarily caused by vortex formation as a result of a flow of air around curved surfaces between differential upper and lower surface pressure distributions. The drag increase caused by the vortex thus formed varies in proportion to the square of the vehicle's velocity. Thus, drag is a rapidly increasing problem as speed increases.

One attempt to redress the problem of drag is to redirect air through the vehicle. U.S. Pat. No. 3,437,371 provides an example of such a system in which air is drawn in through slots at the rear portion of the vehicle and is routed through pipes to the front of the vehicle. The front area of the vehicle is at a low pressure and provides the suction force to draw the air in through the slots in the rear of the vehicle thereby reducing the pressure differential.

Another attempt to reduce the effects of the problem of drag is disclosed in U.S. Pat. No. 5,908,217. Compressed air is blown out through vents at the rear of the vehicle in the portion where the low pressure is normally created by the movement of the car. This combats the pressure differential.

Even though inventors are continually working to reduce the drag on vehicles, the air must still be pushed aside as the vehicle moves forward. This inherent problem greatly limits the fuel efficiency of vehicular travel.

Accordingly, there is a need for a means of travelling in a passageway with little or no air.

SUMMARY OF THE INVENTION

The invention is a method for reducing resistance to the motion of vehicles due to air displacement and air friction by reducing the air pressure in an enclosed passageway for the vehicles. Air pumps are attached to the passageway at regular intervals for reducing the pressure.

In the preferred embodiment of the invention the pressure in the passageway is reduced by at least a factor of 10, so that the pressure in the low pressure passageway is 1/10 of atmospheric pressure.

The invention further facilitates the entrance of vehicles into the low pressure passageway by providing one or more balance rooms at the intersection of the low pressure passageway and a higher pressure area outside the low pressure passageway. The balance rooms each comprise:

(a) a balance room passageway connected (i) to the low pressure passageway on one end or a lower pressure balance room and (ii) to the area outside the low pressure passageway or a higher pressure balance room on the other end;

(b) an airtight door between the balance room passageway and the low pressure passageway or the lower pressure balance room;

(c) an airtight door between (i) the balance room and (ii) the area outside the low pressure passageway or the higher pressure balance room;

(d) a valve between (i) the low pressure passageway or the lower pressure balance room and (ii) the balance room passageway; and (e) a valve between (i) the balance room passageway and (ii) the area outside the low pressure passageway or the higher pressure balance room.

In a preferred embodiment of the invention, the doors of the balance rooms are moved by means of hydraulic force.

In another embodiment of the invention, the vehicles pass from the area outside the low pressure passageway through the balance room in the following steps:

(a) the door and valve between the low pressure passageway and the balance room are closed;

(b) the door and valve between the area outside the low pressure passageway and the balance room are open;

(c) the vehicle or vehicles pass from the area outside the low pressure passageway into the balance room;

(d) the door and valve between the area outside the low pressure passageway and the balance room close;

(e) the valve between the low pressure passageway and the balance room opens, equalizing the pressure between the low pressure passageway and the balance room;

(f) the door between the low pressure passageway and the balance room opens;

(g) the vehicle or vehicles pass from the balance room into the low pressure passageway;

(h) the door and valve between the low pressure passageway and the balance room close; and (i) the door and valve between the balance room and the area outside the low pressure passageway open.

In another embodiment of the invention, the resistance to the motion of vehicles due to air displacement and air friction in an enclosed passageway for the vehicles is reduced by filling the passageway with a gas with a lower molecular mass than air.

DETAILED DESCRIPTION OF THE PREFERRED EMBODIMENTS

Figure 1:
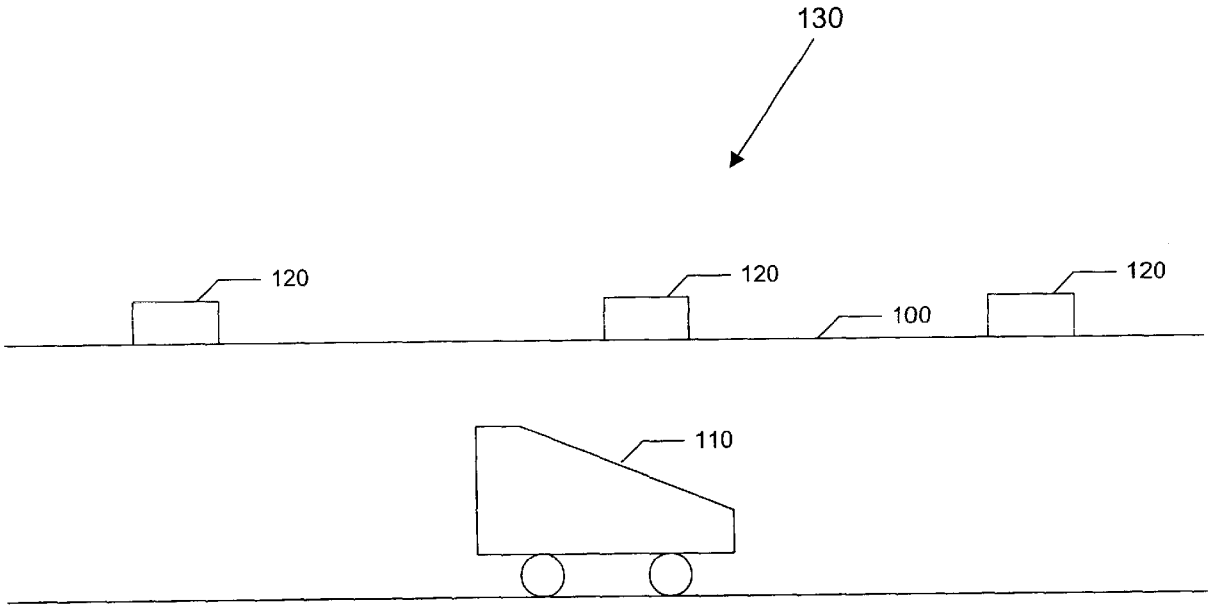
FIG. 1 is a drawing of an enclosed passageway and a vehicle travelling in the enclosed passageway.

FIG. 1 is a drawing of an enclosed passageway (100) and a vehicle (110) travelling in the enclosed passageway (100). There are pumps (120) attached to the enclosed passageway (100) at regularly spaced intervals. These pumps (120) pump air from the enclosed passageway (100) out to the surrounding space (130). This results in a pressure below atmospheric pressure inside the enclosed passageway (100).

Figure 2:
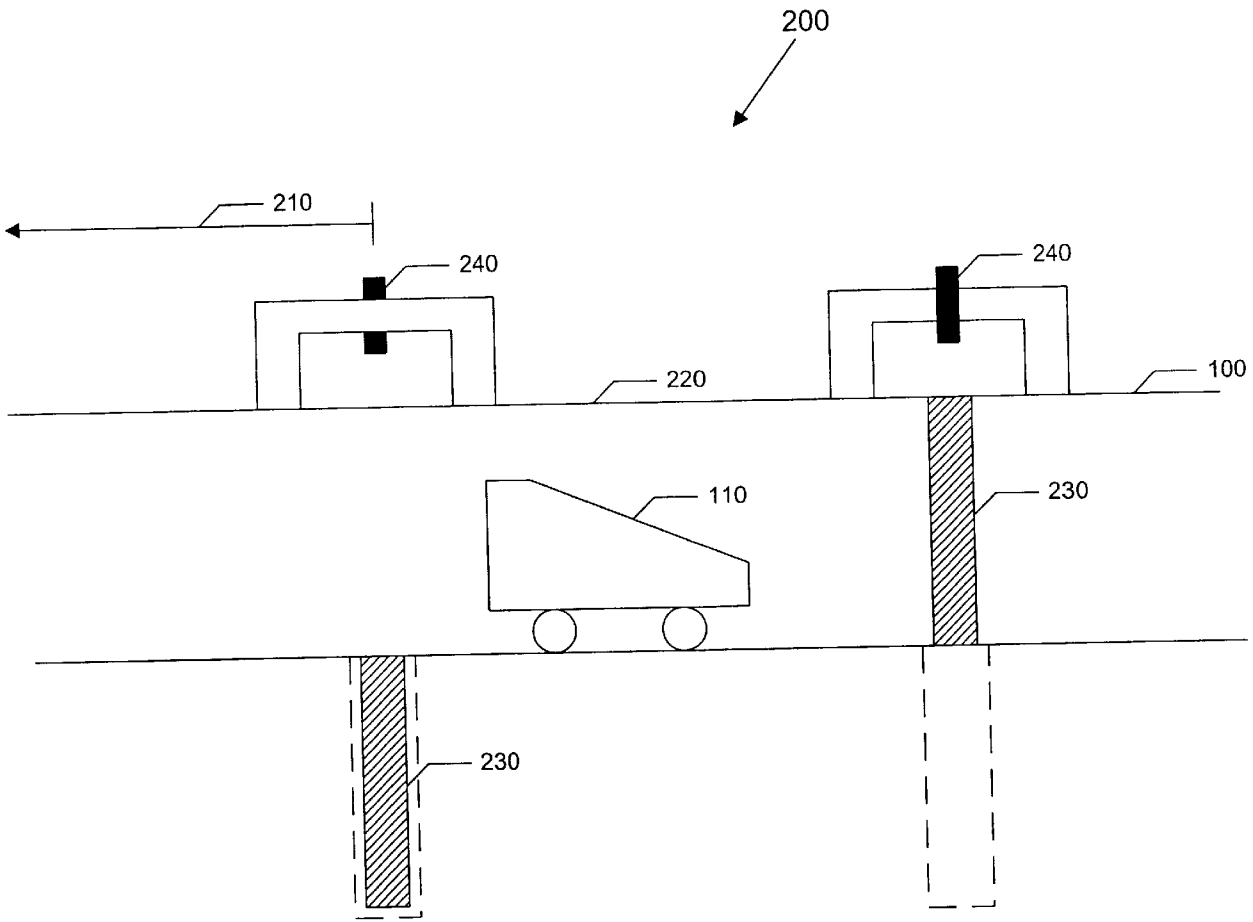
FIG. 2 is a drawing of a balance room for the entrance of vehicles into a low pressure passageway.

FIG. 2 is a drawing of a balance room (200) for the entrance of vehicles (110) into a low pressure passageway (100). The balance room (200) allows for the vehicles (110) to enter the passageway (100) without significantly reducing the pressure in the passageway (100). The vehicles (110) are travelling from an area of higher pressure (210) into an area of low pressure, the low pressure passageway (100). Without such balance rooms (200), when the vehicle (110) passed from the high pressure area (210) into the low pressure passageway (100), air would rush from the high pressure area (210) into the low pressure passageway (100). The balance room (200) limits the amount of air transferred to the low pressure passageway (100) upon entrance of the vehicle (110) to the low pressure passageway (100). There is never a direct path for air to travel from the high pressure area (210) to the low pressure passageway (100).

Figure 4:
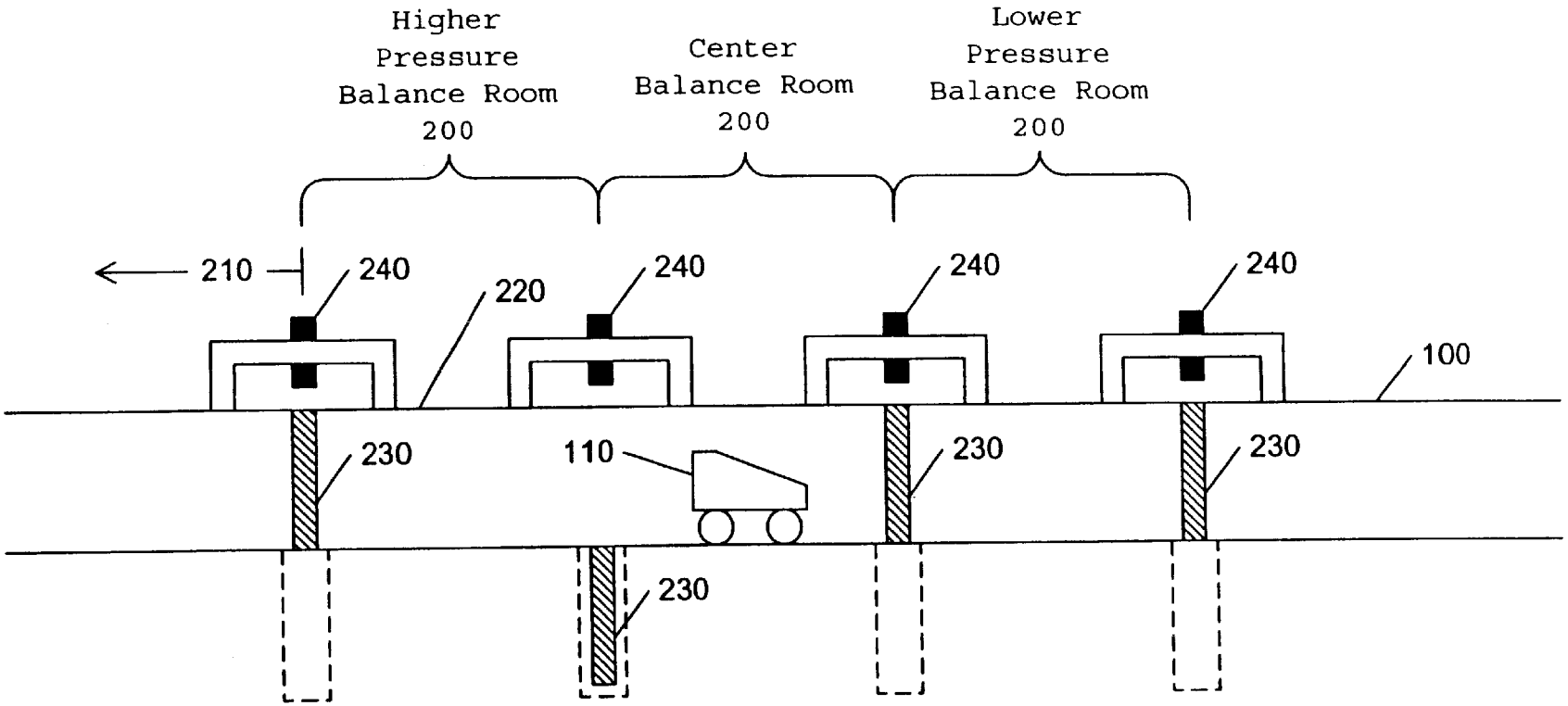
FIG. 4 is a drawing of a balance room for the entrance of a vehicle into a low pressure passageway.

FIG. 4 displays balance room (200) in the center with two additional balance rooms (200) on opposite sides, one at higher pressure and one at a lower pressure than the balance room (200) located in the center.

The balance room (200) includes (a) a balance room passageway (220) connected (i) to the low pressure passageway (100) on one end or a lower pressure balance room and (ii) to the area outside the low pressure passageway (210) or a higher pressure balance room (200) on the other end;

(b) an airtight door (230) between the balance room passageway (220) and the low pressure passageway (100) or the lower pressure balance room (200);

(c) an airtight door (230) between (i) the balance room passageway (220) and (ii) the area outside the low pressure passageway (210) or the higher pressure balance room (200);

(d) a valve (240) between (i) the low pressure passageway (100) or the lower pressure balance room (200) and (ii) the balance room passageway (220); and (e) a valve (240) between (i) the balance room passageway (220) and (ii) the area outside the low pressure passageway (210) or the higher pressure balance room (200).

In a preferred embodiment of the invention, the doors (230) of the balance rooms (200) are moved by means of hydraulic force.

Figure 3:
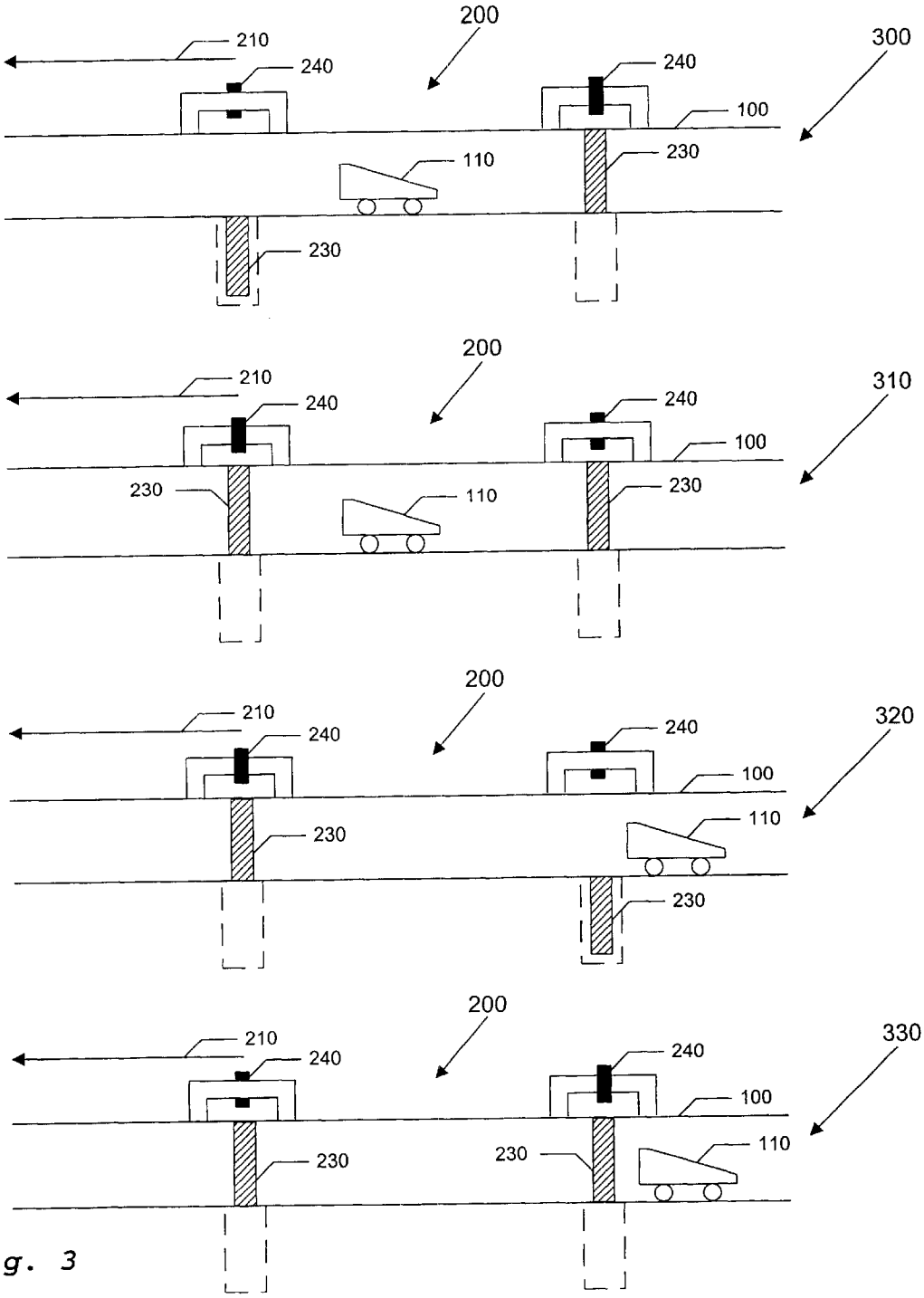
FIG. 3 a drawing of the steps necessary for entrance of a vehicle into the low pressure passageway from the area outside the low pressure passageway through the balance room.

FIG. 3 is a drawing of the steps necessary for entrance of a vehicle (110) into the low pressure passageway (100) from the area outside the low pressure passageway (210) through the balance room (200). In step one (300), the door (230) and valve (240) between the area outside the low pressure passageway (210) and the balance room (200) are open and the door (230) and valve (240) between the low pressure passageway (100) and the balance room (240) are closed.

In step two, (310) the vehicle (110) or vehicles (110) pass from the area outside the low pressure passageway (210) into the balance room (200), the door (230) and valve (240) between the area outside the low pressure passageway (210) and the balance room (200) close and the valve (240) between the low pressure passageway (100) and the balance room (200) opens, equalizing the pressure between the low pressure passageway (100) and the balance room (200).

In step three (320), the door (230) between the low pressure passageway (100) and the balance room (200) opens, the vehicle (110) or vehicles (110) pass from the balance room (200) into the low pressure passageway (100).

In step four (330), the door (230) and valve (240) between the low pressure passageway (100) and the balance room (200) close. Finally, in step five (340), the door (230) and valve (240) between the balance room (200) and the area outside the low pressure passageway (210) open.

Preferably in each case where a door (230) and valve (240) at the same location open one after the other, the valve (240) opens before the door (230). Conversely, in each case where a door (230) and valve (240) at the same location close one after the other, the door (230) closes before the valve (240). This way, the door (230) is always opening or closing with equal pressures on both sides.

In another embodiment of the invention, the resistance to the motion of vehicles (110) due to air displacement and air friction in an enclosed passageway (100) for the vehicles (110) is reduced by filling the passageway (100) with a gas with a lower molecular mass than air.

It will be apparent to those skilled in the art that modifications may be made without departing from the spirit and scope of the invention. Accordingly, it is not intended that the invention be limited except as may be necessary in view of the appended claims.

What is claimed is:

1. A method of allowing a vehicle to pass through a passageway with reduced resistance due to air friction and air displacement, comprising the steps of:

enclosing a passageway through which the vehicle is to be passed;

filling the enclosed passageway with a gas having a lower molecular mass than air to reduce the resistance to the movement of the vehicle in the enclosed passageway; and allowing the vehicle to pass through the enclosed passageway.

2. The method of claim 1, further comprising reducing gas pressure in the enclosed passageway to create a low pressure passageway.

3. The method of claim 2, wherein reducing the gas pressure further comprises attaching gas pumps to the passageway at regular intervals and pumping gas out of the passageway with the gas pumps to reduce the gas pressure.

4. The method of claim 2, further comprising providing a balance room between the low pressure passageway and a higher pressure area outside the low pressure passageway.

5. The method of claim 4, wherein providing a balance room comprises:

providing a balance room passageway having first and second ends, the first end connected to (i) the low pressure passageway or a lower pressure balance room; and the second end connected to (ii) an area outside the low pressure passageway or a higher pressure balance room;

providing a first airtight door between the balance room passageway and the low pressure passageway or the lower pressure balance room;

providing a second airtight door between (i) the balance room and (ii) the area outside the low pressure passageway or the higher pressure balance room;

providing a first valve between (i) the low pressure passageway or the lower pressure balance room and (ii) the balance room passageway; and providing a second valve between (i) the balance room passageway and (ii) the area outside the low pressure passageway or the higher pressure balance room.

6. The method of claim 5, further comprising moving the first and second airtight doors by hydraulic force.

7. The method of claim 5, wherein allowing the vehicle to pass further comprises:

opening the second airtight door and second valve between the area outside the low pressure passageway and the balance room;

closing the first airtight door and first valve between the low pressure passageway and the balance room;

allowing the vehicle to pass from the area outside the low pressure passageway into the balance room;

closing the second airtight door and second valve between the area outside the low pressure passageway and the balance room;

opening the first valve between the low pressure passageway and the balance room, thereby equalizing the pressure between the low pressure passageway and the balance room;

opening the first airtight door between the low pressure passageway and the balance room;

allowing the vehicle to pass from the balance room into the low pressure passageway;

closing the first airtight door and first valve between the low pressure passageway and the balance room; and opening the second airtight door and second valve between the balance room and the area outside the low pressure passageway.

8. The method of claim 2, wherein reducing the gas pressure further comprises reducing the gas pressure by at least a factor of 10, so that the pressure in the low pressure passageway is 1/10 of atmospheric pressure.

9. A system for transportation with reduced resistance due to air displacement and air friction, the system comprising:

a vehicle configured for movement;

a gas having a lower molecular mass than air; and an enclosed passageway filled with the gas to reduce the resistance to the movement of the vehicle in the enclosed passageway.

10. The system of claim 9, further comprising gas pumps attached to the passageway at regular intervals, wherein the gas pumps reduce the gas pressure of the enclosed passageway so as to create a low pressure passageway.

11. The system of claim 10, wherein the gas pumps reduce the pressure by at least a factor of 10, so that the pressure in the low pressure passageway is 1/10 of atmospheric pressure.

12. The system of claim 10, further comprising a balance room between the low pressure passageway and a higher pressure area outside the low pressure passageway.

13. The system of claim 12, wherein the balance room comprises:

a balance room passageway having first and second ends, the first end connected to (i) the low pressure passageway or a lower pressure balance room; and the second end connected to (ii) the area outside the low pressure passageway or a higher pressure balance room;

a first airtight door between the balance room passageway and the low pressure passageway or the lower pressure balance room;

a second airtight door between (i) the balance room and (ii) the area outside the low pressure passageway or the higher pressure balance room;

a first valve between (i) the low pressure passageway or the lower pressure balance room and (ii) the balance room passageway; and a second valve between (i) the balance room passageway and (ii) the area outside the low pressure passageway or the higher pressure balance room.

14. The system of claim 13, further comprising hydraulics for moving the doors.

15. A system for transportation with reduced resistance due to air displacement and air friction, the system comprising:

a vehicle configured for movement;

an enclosed passageway configured to allow the vehicle to move, the enclosed passageway filled with a gas having a lower molecular mass than air to reduce the resistance to the movement of the vehicle in the enclosed passageway;

a means for filling the enclosed passageway with the gas; and a means for reducing the gas pressure of the enclosed passageway.

16. The system of claim 15, further comprising a means for limiting the movement of gas between the enclosed passageway and the area outside the enclosed passageway.

* * * * *